US005885865A

United States Patent [19]

Liang et al.

[11] Patent Number: 5,885,865

[45] Date of Patent: Mar. 23, 1999

[54] METHOD FOR MAKING LOW-TOPOGRAPHY BURIED CAPACITOR BY A TWO STAGE ETCHING PROCESS AND DEVICE MADE

[75] Inventors: Mong-Song Liang; Julie Huang; Tse-Liang Ying; Chen-Jong Wang, all of Hsin-Chu, Taiwan

[73] Assignee: Taiwan Semiconductor Manufacturing Co. Ltd., Hsun-Chu, Taiwan

[21] Appl. No.: 851,689

[22] Filed: May 6, 1997

[51] Int. Cl.[6] ..... H01L 21/8242

[52] U.S. Cl. ..... 438/253; 438/254; 438/640

[58] Field of Search ..... 438/253–255, 438/640, 393–396

[56] References Cited

U.S. PATENT DOCUMENTS 5,401,681 3/1995 Dennison .
5,494,841 2/1996 Dennison et al. .
5,604,147 2/1997 Fischer et al. .

*Primary Examiner*—Jey Tsai
*Attorney, Agent, or Firm*—Tung & Associates

[57] ABSTRACT

The present invention discloses a method for making low-topography buried capacitor including the steps of first depositing oxide layers, and then forming a small pre-contact hole by a dry etch method and a large contact hole by a wet etch method while using silicon nitride caps and sidewall spacers previously deposited on the word lines and on the bit lines as etch stop layers. A buried capacitor that has significantly improved topography can be fabricated in a semiconductor device.

15 Claims, 2 Drawing Sheets

METHOD FOR MAKING LOW-TOPOGRAPHY BURIED CAPACITOR BY A TWO STAGE ETCHING PROCESS AND DEVICE MADE

FIELD OF THE INVENTION

The present invention generally relates to a method for forming buried capacitor and more particularly, relates to a method for making low-topography buried capacitor that has a substantially improved topography and reduced step height between a cell array and periphery devices such that the semiconductor structure built can be easily planarized.

BACKGROUND OF THE INVENTION

Dynamic random access memory DRAM cells have been widely used in modern semiconductor devices. They have been named as dynamic because the cells can retain information only for a limited time and they must be read and refreshed periodically. This is in contrast to a static random access memory (DRAM) cell which does not require periodic refresh signals in order to retain stored data. In a typical DRAM cell, the structure includes a transistor and a storage capacitor. When DRAM cells were first developed, planar type storage capacitors which occupy large wafer surface areas are used. As the circuit density increases in modern semiconductor devices where smaller chips are being made and are being packed with ever-increasing number of circuits, the specific capacitance of a storage capacitor must be increased in order to meet such demands.

Different approaches have been used in achieving higher capacitance on limited usage of wafer real estate. For instance, one solution is to store charges vertically in a trench which requires a deep trench formation and encounters significant processing difficulties. The second solution is to build a stacked capacitor on top of the transistor which allows a smaller cell to be built without losing storage capacity. The solution of using a stacked capacitor has become a more accepted and popular approach in the semiconductor fabrication industries.

In modem DRAM cells, smaller dimension and higher capacitance value per unit area are desirable characteristics for achieving high charge storage capacity. A DRAM capacitor is normally formed by two layers of a semi-conducting material and one layer of a dielectric material. For example, a widely used DRAM capacitor utilizes a thin oxide layer sandwiched between two polysilicon layers to produce a high capacitance capacitor cell. The capacitor can be built by stacking over the bit line on the surface of a silicon substrate. The effective capacitance of a stacked cell is increased over that of a conventional planar cell due to its increased surface area.

A typical 16-Mb DRAM cell 10 having a stacked capacitor 20 built on top is shown in FIG. 1. The DRAM cell 10 can be formed in the following manner. First, standard CMOS fabrication steps are used to form the transistor all the way through the gate oxide growth process. To form the word lines 12, a first polysilicon layer of approximately 2,500 Å thick is deposited and then doped with phosphorous. A thick layer of insulating material 16 such as TEOS (tetraethoxy silicate) oxide of approximately 3,000 Å is then deposited on top of the first polysilicon layer. By using standard photomasking processes, the two layers are etched by a plasma etching technique as a stack. After LDD implants are made in the silicon substrate, oxide spacers are formed on the polysilicon gate structure by depositing a thick layer of TEOS oxide of approximately 2,000 Å and then etched by a plasma process. Gates 12 and 14 are thus formed and covered by a thick insulating layer 16 of oxide. A source and drain mask is then applied to carry out an ion implantation process for forming the source and drain regions in the silicon substrate.

In the next fabrication step, photomasking is used to form window openings for the cell contact and plasma etching is used to remove any native oxide layer on the silicon substrate. A second polysilicon layer 22 of approximately 3,500 Å is then deposited and patterned by a photomask to form the lower electrode of the stacked capacitor 20. A dielectric layer 24 of a composite film of oxide-nitride-oxide (ONO) is deposited as the dielectric layer for the capacitor. The total thickness of the ONO composite film is approximately 70 Å. The ONO composite film can be formed by using a thin layer of native oxide as the first oxide layer, depositing a thin nitride layer on top and then oxidizing the nitride layer to grow a top oxide layer. To complete the fabrication of the stacked capacitor, a third polysilicon layer 24 of approximately 2,000 Å thick is deposited on top of the dielectric layer and then doped and patterned by a photomask to form an upper electrode. After the formation of the stacked capacitor, peripheral devices can be formed by masking and ion implantation, followed by the formation of a bit line 28 of a polysilicon/metal silicide material. A thick insulating layer 32 of BPSG or SOG is then deposited over the capacitor and reflowed to smooth out the topography and to reduce the step height. Other back-end-processes such as metalization to form metal lines 34 are used to complete the fabrication of the memory device 10.

The stacked capacitor 10 shown in FIG. 1 has been successfully used in 16 Mb DRAM devices. However, as device density increases to 256 Mb or higher, the planar surface required for building the conventional stacked capacitors becomes excessive and can not be tolerated. Furthermore, the topography of the device formed in FIG. 1 requires more difficult planarization processes to be performed on the DRAM device. For instance, a more recently developed method of chemical mechanical polishing (CMP) can not be used.

It is therefore an object of the present invention to provide a method for making a low-topography buried capacitor that does not have the drawbacks or shortcomings of the prior art methods for making stacked capacitors.

It is another object of the present invention to provide a method for making a low-topography buried capacitor for a DRAM device that is compatible with high density memory cells.

It is a further object of the present invention to provide a method for making a low-profile buried capacitor by first dry etching a small pre-contact hole and then wet etching a large contact hole.

It is yet another object of the present invention to provide a method for making a low-topography buried capacitor by first forming a small pre-contact hole that has significantly sloped sidewalls by manipulating the etchant gas ratio.

It is still another object of the present invention to provide a method for making low-topography buried capacitor by first forming a small pre-contact hole that has a significantly sloped sidewall to expose a small substrate area.

It is another further object of the present invention to provide a method for making low-profile buried capacitor by first forming a small pre-contact hole and then forming a large contact hole substantially parallel to the pre-contact hole in a wet etch process.

It is yet another further object of the present invention to provide a method for forming low-profile buried capacitor by first forming a small pre-contact hole in a dry etch method which stops at the nitride caps and spacers on the word lines and the bit lines and then forming a large contact hole in a wet etch method which stops at the nitride caps and spacers on the word lines and bit lines.

It is still another further object of the present invention to provide a method for forming a low-topography buried contact by first providing a small pre-contact hole and then forming a large contact hole having sidewalls substantially parallel to the sidewalls of the pre-contact hole while stopping at the nitride coating layer on the word lines and the bit lines.

SUMMARY OF THE INVENTION

In accordance with the present invention, a method for making low-topography buried capacitor is provided wherein a small pre-contact hole can be first formed in a dry etch method and then a large contact hole can be formed in a wet etch method having sloped sidewalls substantially parallel to that of the pre-contact hole and stopping at the nitride caps and spacers pre-formed the word lines and the bit lines.

In a preferred embodiment, a method for making low-topography buried capacitor can be carried out by first providing a pre-processed semi-conducting substrate which has word lines and bit lines formed in between inter-poly-oxide (IPO) layers, wherein the word lines and the bit lines are insulated from the IPO layers by a silicon nitride coating, then forming a pre-contact hole having a first sloped sidewall exposing the semi-conducting substrate in a first contact area, then forming a contact hole having a second sloped sidewall exposing the semi-conducting substrate in a second contact area larger than the first contact area, the forming step stops at the silicon nitride coating on the word lines and the bit lines, and depositing polysilicon layers and a dielectric layer sandwiched thereinbetween forming the low-topography buried capacitor.

The present invention is also directed to a low-topography buried capacitor in a semiconductor device which includes a semi-conducting substrate that has field oxide isolations, active regions and at least one word lines built therein, a first inter-poly-oxide layer formed on the substrate, at least one bit line formed on the first inter-poly-oxide layer, wherein the at least one word line and the at least one bit line have a silicon nitride layer formed thereon as etch-stop for the opening of a contact hole, a second inter-poly-oxide layer formed on the first inter-poly-oxide layer sandwiching the bit lines, a contact hole opened in the first and the second inter-poly-oxide layers exposing the semi-conducting substrate, and at least two semi-conducting material layers and a dielectric layer sandwiches thereinbetween deposited in the contact hole for establishing electrical communication with the substrate.

The present invention is also directed to a method for making a low-profile buried capacitor which can be carried out by the steps of providing a front-end processed semi-conducting substrate with word lines and bit lines built therein, insulating the word lines and the bit lines with a silicon nitride coating, forming a pre-contact hole having sloped sidewalls exposing a first contact area on said substrate, forming a contact hole having a sidewall substantially parallel to the sidewall for the pre-contact hole exposing a second contact area on said substrate, said second contact area being larger than said first contact area, and depositing semi-conducting material layers and dielectric layer and forming the low-profile buried capacitor.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a method for making a low-profile buried capacitor by sequentially depositing at least two oxide layers so that a small pre-contact window for the capacitor can be readily formed by a dry-etch process and a large contact window can be formed by a wet etch process. The need for a silicon nitride layer as an etch-stop is eliminated in the preferred embodiment and thus problems caused by the cracking of the nitride layer during high temperature deposition of an oxide-nitride-oxide layer can be avoided.

In a copending application, Attorney Docket Number 67,200-020 (Ser. No. 08/734,560) assigned to the common assignee of the present invention, a method for forming stacked capacitors in DRAM devices in which a polysilicon plug is first formed to contact the wafer and then upper and lower electrodes are formed on the plug by using a silicon nitride etch-stop layer to remove a dielectric material layer is disclosed. A drawback for the process is the requirement of the silicon nitride etch-stop layer. The nitride layer causes processing difficulties such as the cracking of the layer and possible contamination of the fabrication process. For instance, during the final processing steps for forming the dielectric layer and the upper cell plate, a dielectric layer of ONO must be deposited at a high temperature of approximately 800° C. This high deposition temperature causes the cracking the separation of the silicon nitride layer from the inter-poly-oxide layer that it is deposited on.

In an improved process, i.e., in the preferred embodiment of the present invention, the need for the silicon nitride etch-stop layer can be eliminated. The process steps for the preferred embodiment for building a low-topography buried contact is illustrated in FIGS. 2A~2H and FIGS. 3A~3H.

In the preferred embodiment of the present invention, a method for making a low-topography buried capacitor is provided which affords a much improved topography for the semiconductor device built. The process encompasses the steps of first depositing inter-poly-oxide layers on a pre-processed semi-conducting substrate, and then forming a pre-contact hole which has a sloped sidewall controlled by a dry etchant gas ratio to expose the semi-conducting substrate, and then forming a large contact hole which has a slope substantially similar to the slope for the pre-contact hole to expose a larger substrate area. Both the forming processes for the pre-contact hole and for the contact hole are conducted by using the silicon nitride caps and spacers on the word lines and the bit lines as etch stops.

Figure 1:
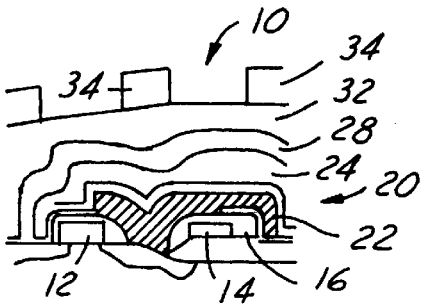
(PRIOR ART) FIG.1
FIG. 1 is an enlarged, cross-sectional view of a conventional stacked capacitor DRAM cell.
Figure 2A:
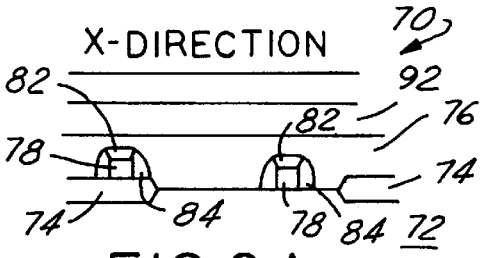
FIG. 2A is an enlarged, cross-sectional view of a preferred embodiment of the present invention pre-processed substrate shown in the word line direction.

Referring initially to FIG. 2A, wherein a present invention preferred embodiment semiconductor structure 70 is shown in the X-direction or in the word line direction. It is seen that onto a silicon substrate 72 active regions for transistors (not shown) and LOCOS type field oxide isolations 74 are built with polysilicon word lines 78 formed on top. After the formation of the polysilicon word lines or gates 78, silicon nitride caps 82 and silicon nitride sidewall spacers 84 are formed by depositing and anisotropic etching a nitride layer to encase the word lines 78. A first inter-poly-oxide layer (IPO-1) 84 of between 3000~5000 Å thickness is then deposited to insulate the word lines 78.

Figure 3A:
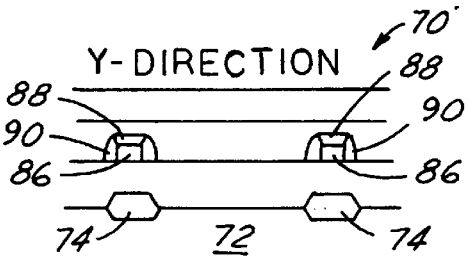
FIGS. 3A~3H are similar to FIGS. 2A~2H except that the views are taken in the bit line direction.

Bit lines 86 are formed by first depositing a polysilicon layer and then forming into bit lines on top of the IPO-1 layer 84. This is shown in FIG. 3A. Similarly, silicon nitride caps 88 and silicon nitride sidewall spacers 90 are formed by depositing and anisotropically etching a nitride layer to encase the bit lines 86. A second inter-poly-oxide layer (IPO-2) 92 is then deposited to completely encase and insulate the bit lines 86. It should be noted that FIGS. 2A~2H illustrate the cross-sectional views of the device 70 in the X-direction or in the word line direction, while FIGS. 3A~3H show cross-sectional views of the structure 70 in the Y-direction, or in the bit line direction.

Figure 2B:
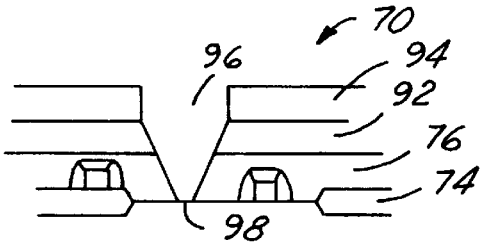
FIG. 2B is an enlarged, cross-sectional view of the preferred embodiment of FIG. 2A having a pre-contact hole etched.
Figure 3B:
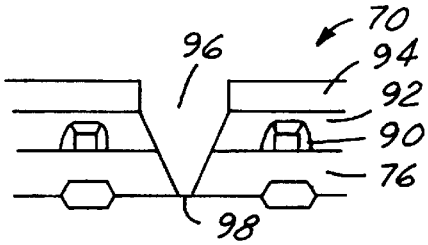

FIG. 2B shows an enlarged, cross-sectional view of the structure 70 of FIG. 2A having a photoresist layer 94 deposited and patterned on top of the IPO-2 layer 92. A dry etch method is then used to etch a tapered opening 96 in the structure 70 through the IPO-2 layer 92 and the IPO-1 layer 76. The pre-contact hole 96 is formed by a dry etching technique wherein the etchant gas ratios can be custom mixed in order to produce a substantially sloped sidewall and thus producing a small contact opening 98. A similar view for the pre-contact hole 96 is also shown in FIG. 3B. The dry etch method which utilizes an etchant gas mixture of $CHF_3$+$CF_4$ at a mixing ratio of 1:1 to 4:1 can be suitably adjusted such that a desirable angle of the taper can be obtained. For instance, in most dry etch processes for oxide material, the angle of the sidewall in relation to the horizontal axis is normally about 85°. In the novel present invention method, the sidewall angle in relation to the horizontal axis can be as low as 70°. The dry etch process conducted is not an anisotropic process.

Figure 2C:
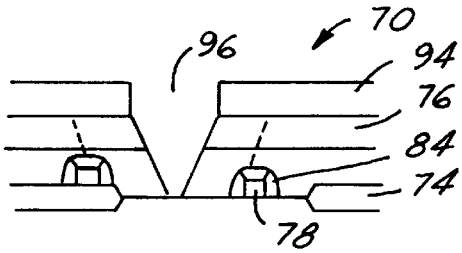
FIG. 2C is an enlarged, cross-sectional view of the preferred embodiment of FIG. 2B having a photoresist layer deposited and patterned on top.
Figure 3C:
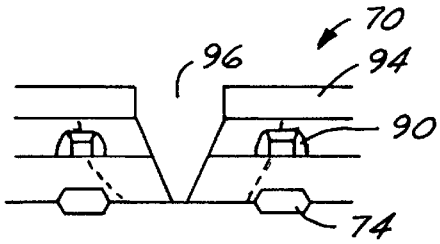
Figure 2D:
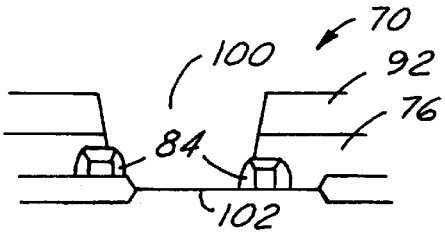
FIG. 2D is an enlarged, cross-sectional view of the preferred embodiment of FIG. 3C having the oxide layer etched away and the photoresist layer removed.
Figure 3D:
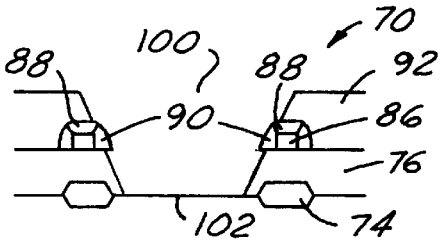

Referring now to FIG. 2D, wherein the dashed area in the IPO-1 and IPO-2 layers shown in FIG. 2C are etched away in a wet dip process wherein a 10:1 BOE etch solution is used. The etch reaction is an anisotropic etching reaction which stops at the nitride caps 82 and the sidewall spacers 84 that was formed on the word lines 78. It is seen that a contact hole 100 is obtained which has a large base substrate area 102 exposed. It should be noted that the base substrate area 102 exposed for the contact hole 100 is substantially larger than the base contact area 98 previously achieved for the pre-contact hole 96. This is made possible by the novel present invention method wherein nitride caps 82 and nitride sidewall spacers 84 are used to stop the wet etching reaction in removing the oxide material from the IPO-1 layer 76 and the IPO-2 layer 92. A similar view in the Y-direction or the bit line direction is shown in FIG. 3D. The silicon nitride sidewall spacers 90 and the silicon nitride caps 88 formed n the bit line 86 effectively serve as an etch stop for the etchant solution such that a desirable dimension of the contact hole can be controlled. It should be noted that by observing FIGS. 2D and 3D, it is clear that both the bit line caps and sidewall spacers and the word line caps and sidewall spacers contribute to the control of the wet etching reaction on the oxide layers 76 and 92.

It should also be noted that while a 10:1 BOE solution was successfully used as the wet etchant in achieving the present invention novel results, other suitable etchant solvent may also be used. For instance, HF may function equally well as the 10:1 BOE solution.

Figure 2E:
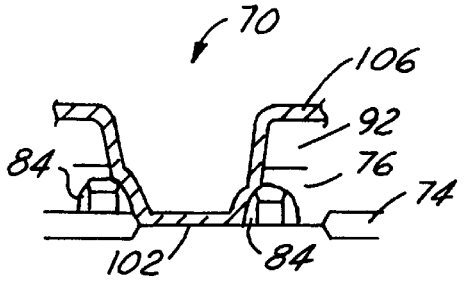
FIG. 2E is an enlarged, cross-sectional view of the preferred embodiment of FIG. 2D having a polysilicon layer deposited thereon.
Figure 3E:
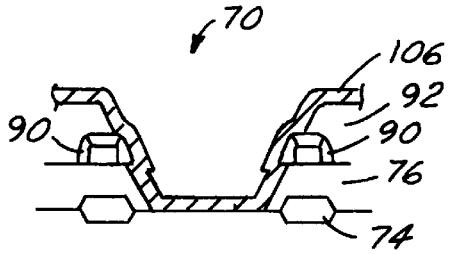
Figure 2F:
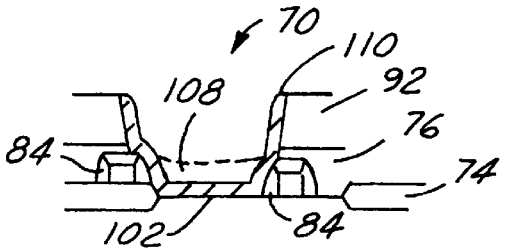
FIG. 2F is an enlarged, cross-sectional view of the preferred embodiment of FIG. 2E having a spin-on-glass layer deposited therein as an etch-stop.
Figure 3F:
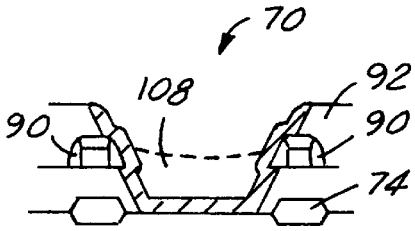
Figure 2G:
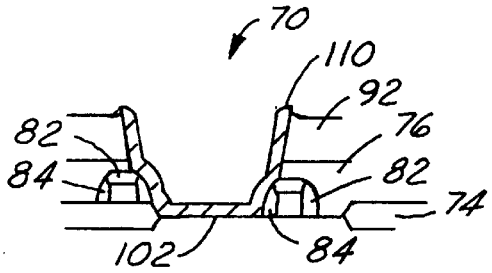
FIG. 2G is an enlarged, cross-sectional view of the preferred embodiment of FIG. 2F having the residual SOG layer removed.
Figure 3G:
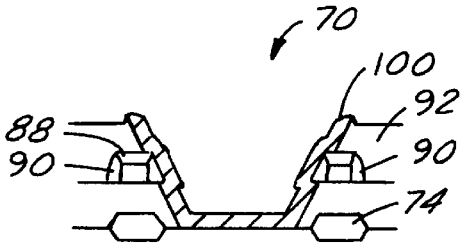
Figure 2H:
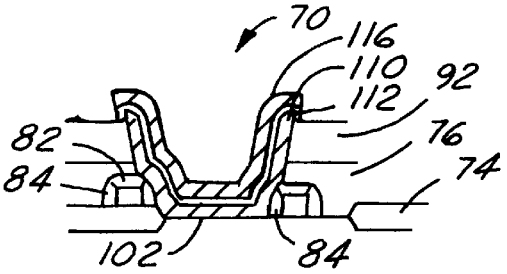
FIG. 2H is an enlarged, cross-sectional view of the preferred embodiment of FIG. 2G having a dielectric layer and a polysilicon layer deposited on top.
Figure 3H:
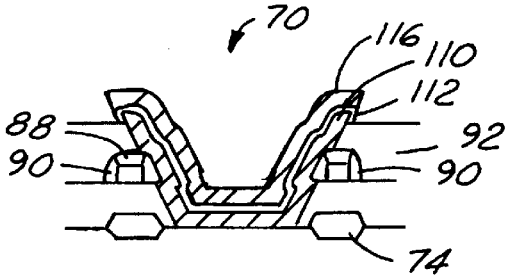

In the next fabrication step, as shown in FIGS. 2E and 3E, a first polysilicon layer 106 is conformally deposited into the contact hole 100 that was previously prepared. The thickness of the layer 106 can be approximately 1000~2000 Å. A spin-on-glass (SOG) layer is then deposited on the structure 70 after a wet dip process for removing the photoresist layer is carried out. The SOG layer (not shown) is then etched back leaving a small residual of SOG 108 at the bottom of the buried capacitor. This is also shown in FIGS. 2F and 3F. In the next fabrication step, as shown in FIGS. 2G and 3G, the remaining SOG material 108 is removed in a wet dip process and a lower electrode 110 for the buried capacitor is defined and formed. Other back-end processes such as the deposition of a dielectric layer 112 of oxide-nitride-oxide (ONO) and the deposition of a second polysilicon layer 116 as the cell plate can be carried out by techniques similar to those used in the semiconductor industry. A completed low-topograph buried capacitor is shown in FIGS. 2H and 3H.

The present invention novel method of fabricating a low-topography or low-profile buried capacitor is therefore fully demonstrated by the above example. The major benefit achieved by the present invention novel method is the topography of the device obtained is much improved and the device can be planarized in an improved method.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. A method for making low-topography buried capacitor comprising the steps of:

providing a pre-processed semi-conducting substrate having word lines and bit lines formed in-between oxide layers, said word lines and bit lines are insulated from said oxide layers by a nitride layer, forming a pre-contact hole having a first sloped sidewall exposing said semi-conducting substrate in a first contact area, forming a contact hole having a second sloped sidewall exposing said semi-conducting substrate in a second contact area larger than said first contact area, and depositing conductive layers and a dielectric layer sandwiched therein directly on said exposed second contact area forming said low-topography buried capacitor.

2. A method according to claim 1, wherein said first sloped sidewalls and said second sloped sidewalls having substantially the same slope.

3. A method according to claim 1, wherein said word lines and bit lines are formed of polysilicon.

4. A method according to claim 1 further comprising the step of forming nitride caps and spacers on said word lines and bit lines.

5. A method according to claim 1, wherein said word lines and bit lines are formed by depositing and forming polysilicon layers on inter-poly-oxide layers.

6. A method according to claim 1, wherein process comprises:

a dry etching method is used in forming said pre-contact hole, and a wet etching method is used in forming said contact hole, said contact hole being larger than said pre-contact hole.

7. A method according to claim 1, wherein said forming process stops at said nitride layer on said word lines and bit lines.

8. A method according to claim 1, wherein said pre-contact hole is formed by a dry etch method during which an etchant gas ratio can be varied to determine the slope of the sidewall.

9. A method according to claim 1, wherein said semi-conducting substrate is a silicon substrate.

10. A method according to claim 1, wherein said nitride layer is an etch-stop layer of either silicon nitride or silicon oxynitride.

11. A method according to claim 1, wherein said deposition step for said conductive layers and a dielectric layer comprises:

depositing a first conductive layer and forming a lower electrode, depositing a dielectric layer and forming an insulator, and depositing a second conductive layer and forming an upper electrode.

12. A method according to claim 11, wherein said first and second conductive layers are polysilicon layers.

13. A method for making low-profile buried capacitor comprising the steps of:

providing a front-end processed semi-conducting substrate having word lines and bit lines formed therein, insulating said word lines and said bit lines with nitride spacers, forming a pre-contact hole by a dry etching process utilizing said nitride spacers as etch-stop and exposing said semi-conducting substrate in a first contact area, forming a contact hole by a wet etching process exposing said semi-conducting substrate in a second contact area larger than said first contact area, and depositing conductive layers and dielectric layer directly on said exposed second contact area forming said low-profile buried capacitor.

14. A method according to claim 13, wherein said dry etching process can be carried out by varying an etchant gas ratio in order to control the sidewall slope of the contact hole.

15. A method according to claim 13, wherein said deposition step for the conductive layers and dielectric layer comprises:

depositing a first conductive layer and forming a lower electrode, depositing a dielectric layer and forming an insulator, and depositing a second conductive layer and forming an upper electrode.

* * * * *